US006059525A

United States Patent [19]

Jiomacas et al.

[11] Patent Number: 6,059,525

[45] Date of Patent: May 9, 2000

[54] LOW STRAIN SHROUD FOR A TURBINE TECHNICAL FIELD

[75] Inventors: Chris Basil Jiomacas, Greenville; Peter Galen Stevens, Simpsonville, both of S.C.

[73] Assignee: General Electric Co., Schenectady, N.Y.

[21] Appl. No.: 09/080,938

[22] Filed: May 19, 1998

[51] Int. Cl.[7] ..... F01D 9/00

[52] U.S. Cl. ..... 415/173.1; 415/189; 415/190; 415/209.2; 415/209.3; 415/209.4; 415/139

[58] Field of Search ..... 415/115, 116, 415/139, 173.1, 189, 190, 209.2, 209.3, 209.4

[56] References Cited

U.S. PATENT DOCUMENTS

| | | | |
|---|---|---|---|
| 4,615,658 | 10/1986 | Kagohara et al. | 415/178 |
| 4,988,266 | 1/1991 | Nakamura et al. | 415/173.1 |
| 5,197,853 | 3/1993 | Creevy et al. | 415/115 |
| 5,219,268 | 6/1993 | Johnson | 415/115 |
| 5,288,206 | 2/1994 | Bromann et al. | 415/209.2 |
| 5,423,659 | 6/1995 | Thompson | 415/173.1 |
| 5,601,402 | 2/1997 | Wakeman et al. | 415/173.2 |

*Primary Examiner*—Edward K. Look
*Assistant Examiner*—Matthew T. Shanley
*Attorney, Agent, or Firm*—Nixon & Vanderhye

[57] ABSTRACT

The flow path shroud includes a plurality of generally channel-shaped shroud segments having forward and rearward rails interconnected by a flow path section along radial innermost portions of the rails. The volume bounded by the forward and rear rails and flow path sections is unbounded at the ends and the shroud therefore is without side walls. The free ends of the front and rear rails have relief cuts such that thermal induced bowing of the front and rear rails in the axial direction limits the mechanical stress applied to the turbine casing hooks. The thickness of the front and rear walls lies in an approximately 1:1 thickness ratio with the thickness of the flow path section.

6 Claims, 3 Drawing Sheets

LOW STRAIN SHROUD FOR A TURBINE

TECHNICAL FIELD

The present invention relates to a shroud for surrounding the tips of turbine buckets or vanes in turbomachinery and particularly relates to shroud segments configured to reduce and minimize thermal strains resultant from transfer of heat from the hot gas flow path through the turbine to the shroud.

BACKGROUND

In a typical turbine, for example, a gas turbine, an annular shroud forms the radially outermost wall surface or flow path surface about the outer tips of rotating blades or buckets in a turbine stage. The annular shroud is typically comprised of a plurality of arcuate segments disposed end-to-end to completely encompass the hot gas flow path. Conventionally, each shroud segment includes forward and rear rails interconnected along radial innermost ends by a flow path section carrying the flow path surface and defining the radial outer limit of the gas flow path. In addition to the flow path section, the forward and rearward rails of each shroud segment have typically been connected to one another by two side walls at the respective opposite circumferential ends of the segment and which essentially extend axially within the turbine shroud. These side walls reinforce the forward and rear rails and, in combination with the rails, define a pocket within the shroud segment which opens radially outwardly.

It will be appreciated that the temperatures in the hot gas flow path of a gas turbine can reach as high as 1600–1700° F. and that the flow path surface of the shroud is exposed to such high hot gas flow path temperatures. However, the forward and rear rails, as well as the side walls, extend radially outwardly of the hot gas flow path and the flow path section of the shroud segment and are therefore subjected to lower temperatures. Consequently, thermal induced stresses within the shroud segments occur as a result of the temperature distribution or gradient about the shroud segment. These induced stresses can cause damage to the shroud segments as well as stress the multiple connections with the turbine shell casing. It will be appreciated that the forward and rear rails of the shroud segments have axially directed flanges or hooks which cooperate with turbine casing hooks to secure the shroud segments to the turbine casing. Thermal stresses on the shroud segments can apply significant forces to the turbine hooks, resulting in high stresses and potential fracture of the turbine casing hooks.

Thermal induced stresses in shrouds have not heretofore been addressed to any large extent. Conventional shroud segments typically have very thick forward and rear rails in comparison with the thickness of the flow path section of the shroud segment. The ratio of the cold mass to the hot mass, i.e., the cold mass of the forward and rear rails and side walls to the hot mass of the flow path section, has been found significant in causing thermal induced stresses having resulting destructive potential.

Furthermore, shroud segments are typically expensive and laborious to manufacture. For example, while continuous turning-type machining of shroud segments is conventional, it is necessary in view of the side walls of the shroud segment to mill the pocket within the segment between the opposite side walls and the forward and rear rails. Necessarily, the milling operations produce thick forward and aft rails which enlarge the cold-to-hot mass ratio. Some shroud segment designs employ a cast-in pocket which, to some extent, reduces the thickness of the forward and rear rails but produces a very expensive design and uses cast material with inferior properties.

DISCLOSURE OF THE INVENTION

According to the present invention, there is provided a shroud segment wherein the ratio of the cold mass to hot mass is optimized to provide an approximate 1:1 ratio of the thickness of the flow path section to the thickness of the forward and rear rails. To further reduce the ratio, the side walls are entirely eliminated such that the space bounded by the forward and rear rails opens through opposite ends of the channel-shaped segments. Additionally, to further relieve stresses on the turbine casing hooks, the forward and rear rail hooks are relief-cut along their end faces. The free ends of the forward and rear rails define end faces which are inset outwardly of the shroud segment hooks such that thermal stresses on the shroud segments tending to bow the forward and rear rails in opposite axial directions are accommodated without applying substantial mechanical stress to the turbine casing hooks. Moreover, by forming the shroud segments without side walls, the shroud segments can be formed essentially entirely on a turning machine which minimizes labor and, hence, costs.

In a preferred embodiment according to the present invention, there is provided a shroud segment for a turbine, comprising a generally channel-shaped shroud body having front and rear rails for connection with a turbine casing and a flow path section interconnecting the front and rear rails and having a flow path surface for exposure to a hot gas flow path through the turbine, each of the front and rear rails and the flow path section having a substantially identical thickness ratio.

In a further preferred embodiment according to the present invention, there is provided a shroud segment for a turbine, comprising a generally channel-shaped shroud body having front and rear rails for connection with a turbine casing and a flow path section interconnecting the front and rear rails and having a flow path surface for exposure to a hot gas flow path through the turbine, the flow path section constituting the sole connection between the front and rear rails of the segment, free ends of the front and rear rails of the shroud body having shroud hooks extending toward one another for connection with turbine casing hooks and end faces including the shroud hooks extending generally parallel to the flow path section, the shroud end faces being relieved along outer marginal portions thereof to prevent binding with the turbine casing hooks.

Accordingly, it is a primary object of the present invention to provide a shroud for surrounding the hot gas path of a turbine formed of a plurality of shroud segments specifically configured to reduce thermal induced stresses by minimizing forward and aft rail thicknesses, employing an approximate 1:1 ratio of the thickness of the forward and rear rails to the thickness of the flow path section, stress relieving the joints between the shroud segments and the turbine casing hooks and enabling formation of the shroud segments by relatively inexpensive turning operations.

BEST MODE FOR CARRYING OUT THE INVENTION

Figure 1:
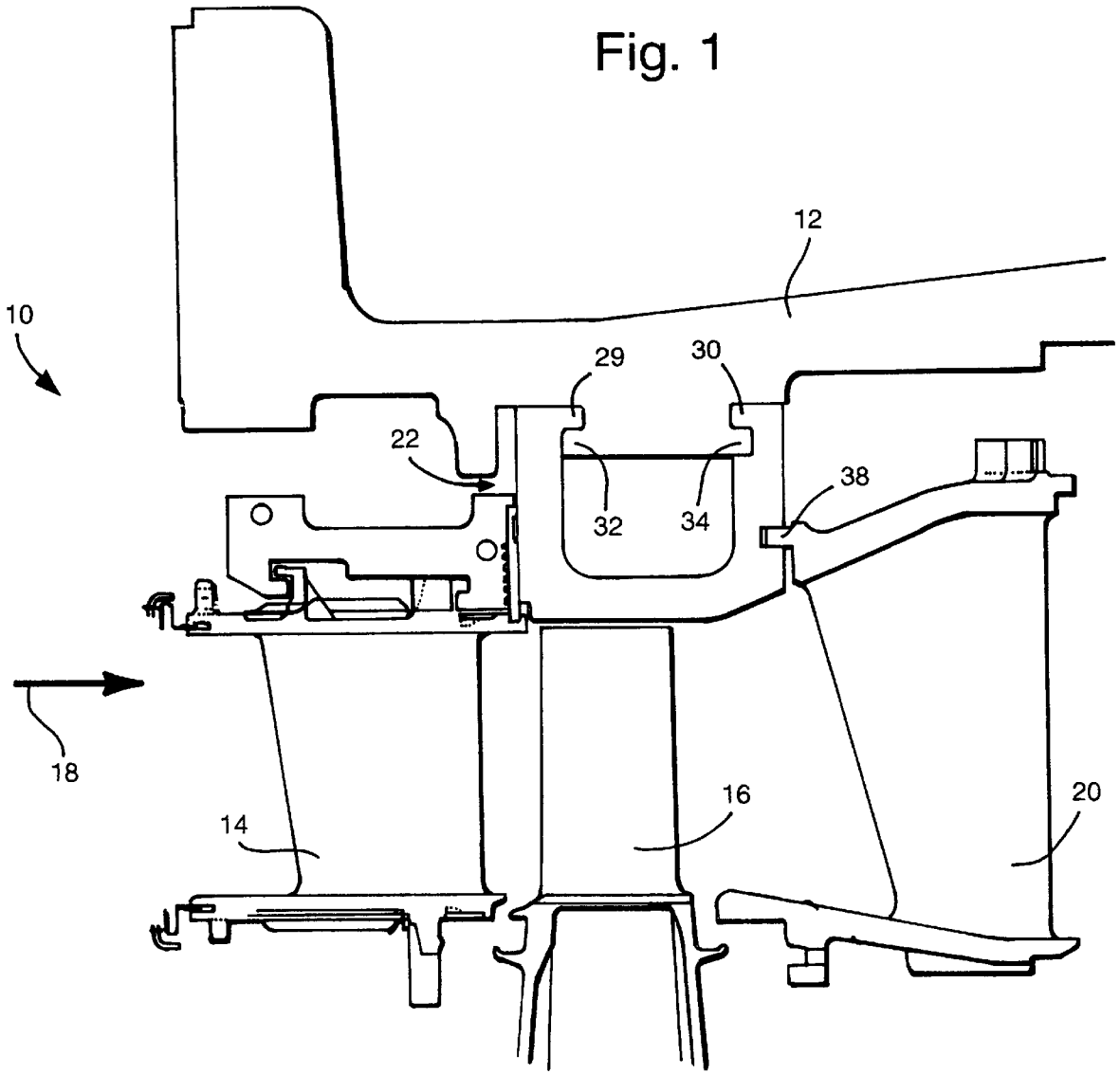
FIG. 1 is a partial axial cross-sectional view illustrating portions of the first two stages of a turbine in which a shroud segment according to the present invention is illustrated.

Referring now to the drawings, particularly to FIG. 1, there is illustrated a turbine, preferably a gas turbine, generally designated 10 and comprised of a turbine shell or casing 12 surrounding the various stages of the turbine. For example, as illustrated, turbine 10 includes a first stage comprised of a plurality of stator vanes or partitions 14 circumferentially spaced one from the other, followed by the stage one blades or buckets 16. It will be appreciated that the stage one nozzle comprised of the stator vanes 14 and the buckets 16 lies in the hot gas path of the turbine as indicated by the arrow 18. Also illustrated is the stage two nozzle 20 and it will be appreciated that stage two nozzle also includes a plurality of buckets, not shown, downstream of the nozzle 20. Additional stages are typically provided. The buckets, of course, typically drive a shaft about an axis.

Figure 2:
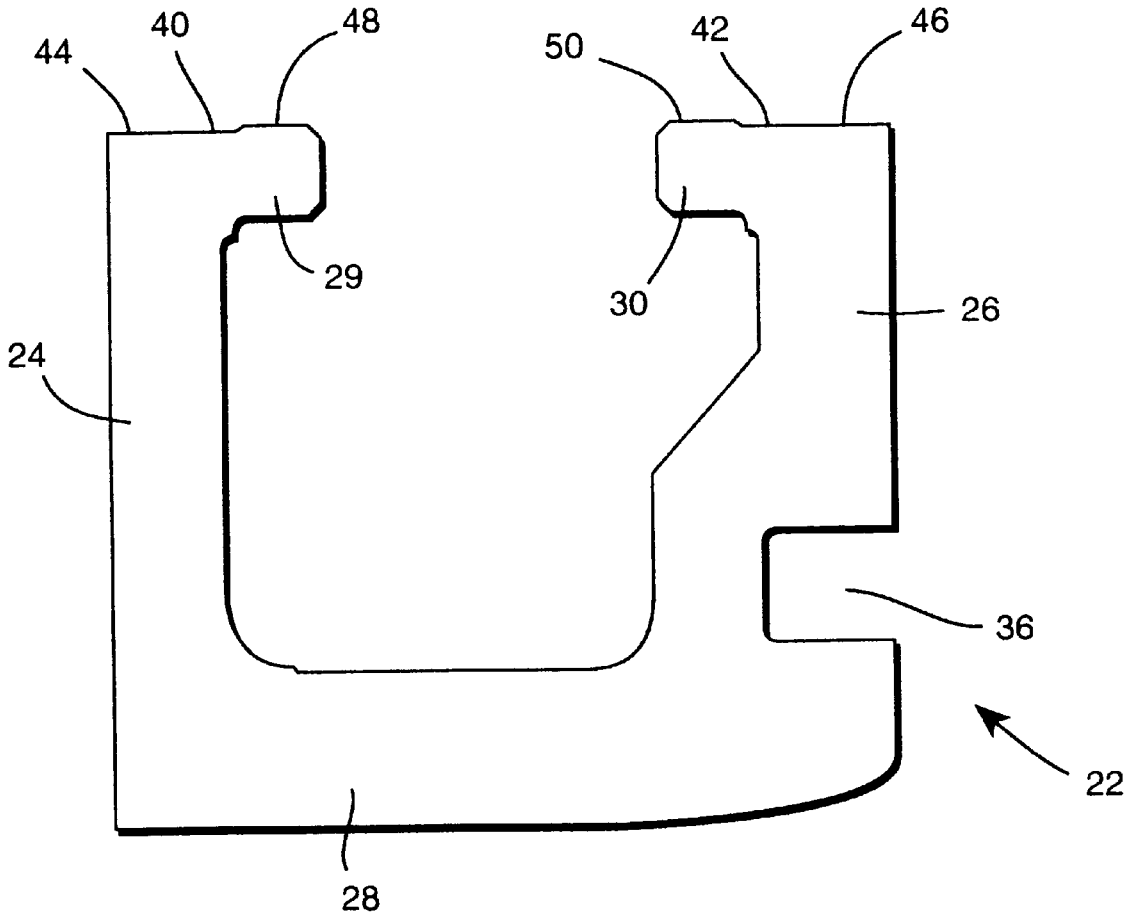
FIG. 2 is a cross-sectional view of a shroud segment hereof.

A shroud, generally designated 22, extends circumferentially about the hot gas path 18 and particularly about the tips of the turbine buckets 16. As illustrated in FIG. 2, the shroud 22 includes a forward rail 24 and a rear rail 26, the terms forward and rear being used in connection with the upstream and downstream directions, respectively, of the hot gas flow through the turbine. A flow path section 28 interconnects the radial innermost portions of the forward and rear rails 24 and 26, respectively. The free ends of the forward and rear rails 24 and 26 terminate, preferably in respective rearward and forwardly projecting hooks or flanges 29 and 30, respectively. It will be appreciated, however, that the hooks can extend axially away from one another or in the same upstream or downstream direction. As illustrated in FIG. 1, the hooks 29 and 30 cooperate with axially directed casing hooks 32 and 34, respectively, to retain the shroud segments secured to the turbine casing 12. It will be appreciated that the shroud 22 is comprised of a plurality of shroud segments which lie end-to-end forming a complete annulus about the hot gas flow path. For example, in a preferred embodiment, forty-eight shroud segments are provided.

It will be appreciated from a review of FIG. 2 that the generally channel-shaped shroud segments are open at opposite ends. That is, the space or volume bounded by the forward and rear rails 24 and 26, respectively, and the flow path section 28 extends throughout the circumferential extent of the shroud segments and opens through the open opposite ends of the shroud segment. Hence, the front and rear rails 24 and 26 are unsupported in the segments, except by the connection afforded by the flow path section 28. The rear rail 26 also has a slot 36 for receiving a tongue or flange from the next nozzle stage outer ring, i.e., the flange 38 illustrated in FIG. 1. The shroud segments are formed of a metal alloy.

In accordance with the present invention, it will be appreciated that the thickness of the forward and rear rails 24 and 26 are substantially in a 1:1 ratio with the thickness of the flow path section 28. This optimizes the ratio of the cold mass to the hot mass, thus reducing and minimizing thermally induced stress. While the rear rail 26 steps rearwardly in a central position thereof as illustrated in FIG. 2 and which prevents maintenance of an exact constant wall thickness through its radial extent, the major portions of the radial extent of the rear rail does have substantially the same thickness as the thickness of the front rail and the gas path section 28.

Referring now to FIG. 2, the free ends of the forward and rear rails 24 and 26, respectively, have end faces 40 and 42, including the hooks 29 and 30, respectively. Each of the end faces 40 and 42 has a relief cut to minimize the mechanical stress placed on the turbine casing hooks 32 and 34 by mechanical and thermal deflection induced in the shroud segment. Thus, the end surface 40 of the forward rail 24 includes a forwardmost inset portion 44, while the end surface 42 includes an inset rearmost portion 46. The portions 48 and 50 of the end surfaces 40 and 42, respectively, project slightly radially outwardly of surfaces 44 and 46 to ensure engagement in the slots formed by the casing hooks 32 and 34. In this manner, any thermally induced stress in the forward and rear rails resulting in a tendency for those rails to bow axially away from one another minimizes mechanical stresses imposed upon the turbine casing hooks 32 and 34.

Figure 4:
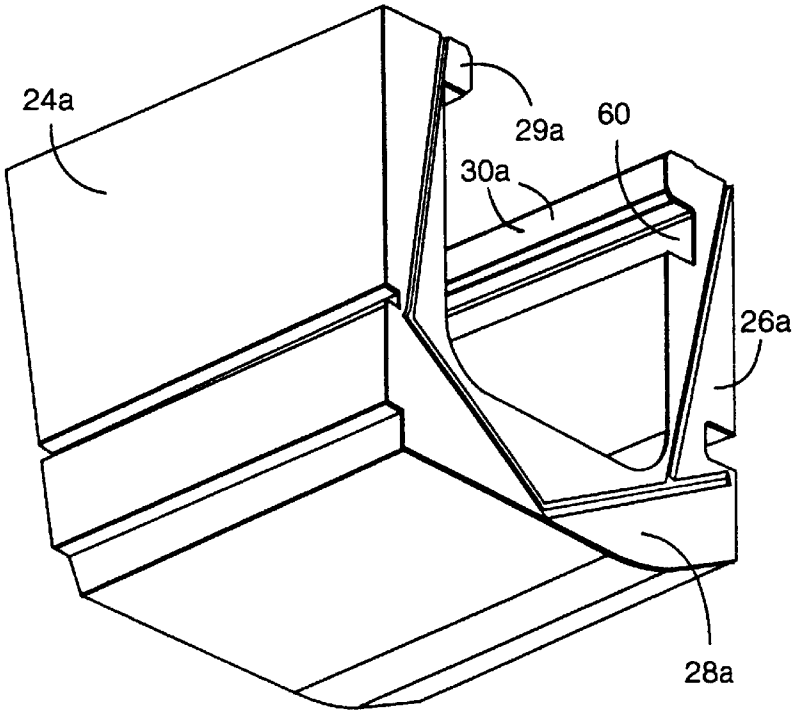
FIGS. 3 and 4 are perspective views of another form of a shroud segment hereof.
Figure 3:
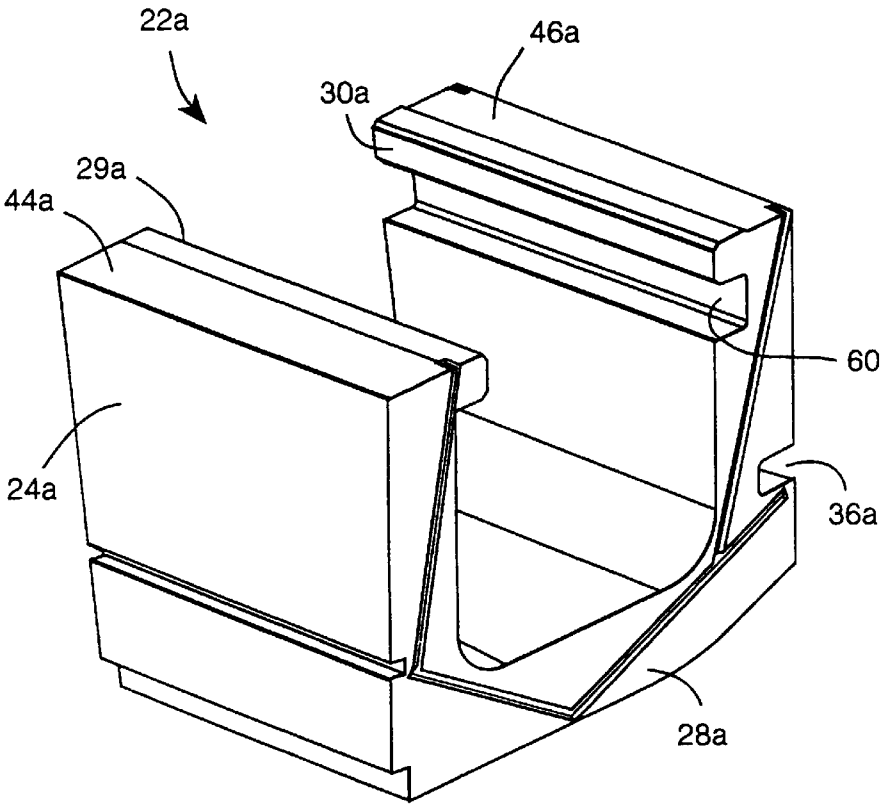

Referring to FIGS. 3 and 4 wherein like parts are referred to by like numbers as in the prior embodiment, followed by the suffix a, there is illustrated a similar shroud segment 22*a* having forward and trailing rails 24*a* and 26*a* connected along their inner edges by flow path section 28*a*. In this form, however, the rearward rail 26*a* is not stepped but is substantially constant in thickness except in the areas of the groove 60 for receiving the locator hook 34 and the groove 36*a* for receiving the tongue or flange of the next nozzle stage outer ring, i.e., flange 38.

It will be appreciated that with the foregoing configuration of the shroud, and particularly with the elimination of the conventional side walls in the shroud by providing a through opening in the space bounded by the forward and rear rails and flow path section, the shroud may be manufactured substantially solely by a turning operation. That is, milling or casting pockets within each shroud segment has been eliminated. The formation of the shroud segments essentially by a turning action also reduces costs. Additionally, it will be appreciated that the shroud configuration of the present invention is particularly useful in the stage one shroud of the turbine. The stage one shroud is, of course, subjected to higher flow path temperatures than are the shrouds of later stages downstream thereof and which have smaller radial cross-sections. That is, the downstream shrouds do not have as large a cold-to-hot mass ratio as the stage one shroud and this particular configuration of shroud is therefore highly useful as a stage one shroud.

While the invention has been described in connection with what is presently considered to be the most practical and preferred embodiment, it is to be understood that the invention is not to be limited to the disclosed embodiment, but on the contrary, is intended to cover various modifications and equivalent arrangements included within the spirit and scope of the appended claims.

What is claimed is:

1. A shroud segment for a turbine, comprising:

a generally channel-shaped shroud body having front and rear rails for connection with a turbine casing and a flow path section interconnecting said front and rear rails and having a flow path surface for exposure to a hot gas flow path through the turbine, each of said front and rear rails and said flow path section having a substantially identical thickness ratio, free ends of said front and rear rails of said shroud body having shroud hooks extending toward one another for connection with turbine casing hooks, said free ends of said front and rear rails having end faces facing away from and generally parallel to said flow path section, said front rail end face having forward and rearward surface portions generally parallel to said flow path section, said rear rail end face having forward and rearward surface portions generally parallel to said flow path section, the forward surface portion of said front rail being inset from the rearward surface portion thereof in a direction toward said flow path section and the rearward surface portion of said rear rail being inset from the forward surface portion thereof in a direction toward said flow path section.

2. A segment according to claim 1 wherein said flow path section constitutes the sole connection between said front and rear rails of said segment.

3. A segment according to claim 1 wherein the front and rear rails and said flow path section define a space bounded thereby, said space opening through opposite ends of said shroud body.

4. A shroud for a turbine, comprising:

a plurality of said generally channel-shaped shroud segments according to claim 1 arranged end-to-end in an annulus about an axis with the channels of the segments opening radially outwardly.

5. A segment according to claim 4 in combination with said turbine, said shroud forming part of a first stage of said turbine.

6. A segment according to claim 1 wherein said rear rail has a slot along an outer surface thereof intermediate said flow path section and said rear rail end face for receiving a flange of an adjacent nozzle stage.

* * * * *